United States Patent [19]

Kremm

[11] 4,282,920

[45] Aug. 11, 1981

[54] GRILLE

[75] Inventor: Paul E. Kremm, Lindenhurst, N.Y.

[73] Assignee: Jim Walter Doors North American, Div. of The Celotex Corp., Tampa, Fla.

[21] Appl. No.: 51,620

[22] Filed: Jun. 25, 1979

[51] Int. Cl.[3] ..... E06B 9/08

[52] U.S. Cl. ..... 160/133

[58] Field of Search ..... 160/133, 116; 403/242, 403/254, 272

[56] References Cited

U.S. PATENT DOCUMENTS

| | | | |
|---|---|---|---|
| 2,898,988 | 8/1959 | Zoll | 160/133 |
| 3,348,699 | 10/1967 | Mealing | 403/242 |
| 3,637,241 | 1/1972 | Dinlocker | 403/242 |
| 4,120,340 | 10/1978 | Stascavage et al. | 160/133 |

*Primary Examiner*—Philip C. Kannan

*Attorney, Agent, or Firm*—Bauer & Amer

[57] ABSTRACT

To a grille of standard construction there are added plastic slats to provide a solid barrier creating maximum security and visibility, wherein opposite ends of the added slats are merely crimped to prevent their removal from the construction. The crimping, however, is not vulnerable to tampering due to their out-of-reach location in the tracking structure of the grille.

4 Claims, 6 Drawing Figures

PRIOR
ART

GRILLE

The present invention relates generally to an integrated rolling grille and plastic slat construction of the type used for shopping malls and the like, and more particularly to improvements in maintaining the mounted position of the slats in the grille.

So-called rolling or overhead grilles are in common use in shopping malls to provide security without completely shutting off visibility of the premises protected behind the grille. As exemplified by U.S. Pat. No. 4,120,340, however, it is already known that the grille should be additionally provided with plastic slats filling the spacing between the rods thereof, otherwise there may be foreign-matter penetration of the grille, such as a lit cigarette, that could have serious adverse consequences. While the known techniques of integrating such plastic slats in the grille are generally effective, they call for firm connection of the slats to the grille structure undoubtedly in the belief that only in this way can tampering be prevented, and thus the security function of the added-on slats not undermined.

Broadly, it is an object of the present invention to provide an improved effectively integrated plastic slat and grille combination overcoming the foregoing and other shortcomings of the prior art. More specifically, it is an object to use a simple technique for integrating the slats and grille, which admittedly if exposed would be vulnerable to vandalism, but which is advantageously in a protected, and thus practically tamper-proof, location in the grille construction, and thus is as effective as the prior art, but without the complexity and attendant cost.

An improved grille demonstrating objects and advantages of the present invention includes two vertically oriented hollow members, serving as tracks for the grille, disposed along opposite sides of the building opening protected by the grille. Each link of the grille has a slot sized to receive plural transparent plastic slats to fill the spacing between the rods of the grille, each slat being long enough to extend the entire width of the grille and into the hollow members or tracks. However, before such positioning, the slat ends are crimped so as to obviate their sliding movement through the slots of those links situated along opposite sides of the grille. After the crimping and installation of the grille in the tracks, the crimped slat ends are only nominally vulnerable to tampering because of their position in the tracks, and yet are effective in maintaining the slats in position on the grille.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
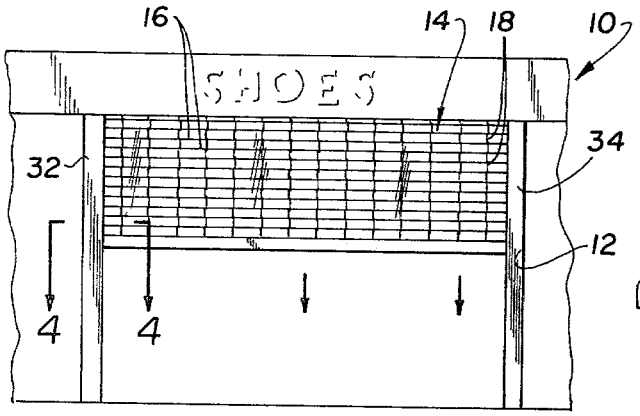
FIG. 1 is a front elevational view illustrating the manner in which the within, as well as prior art, grilles are typically operatively disposed for opening and closing movement in a building opening.
Figure 4:
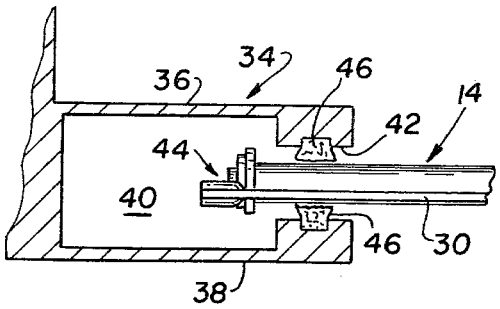
Figure 5:
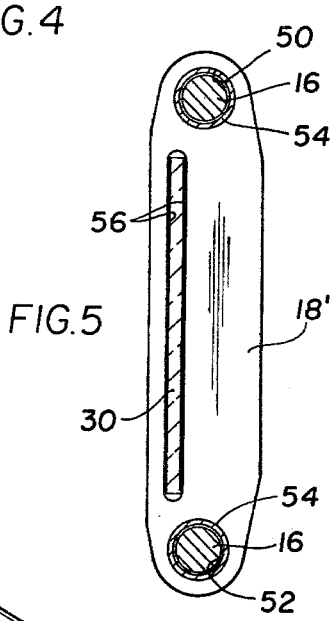
Figure 3:
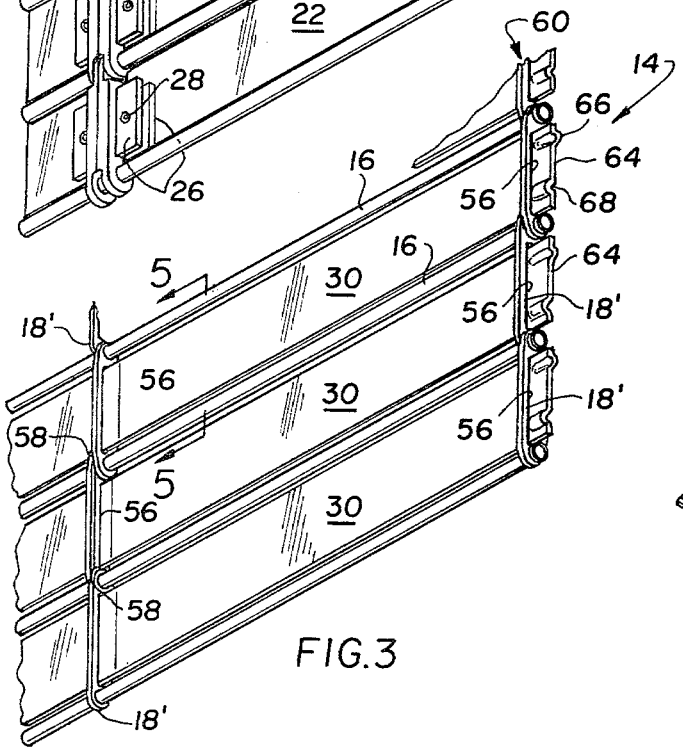
Figure 6:
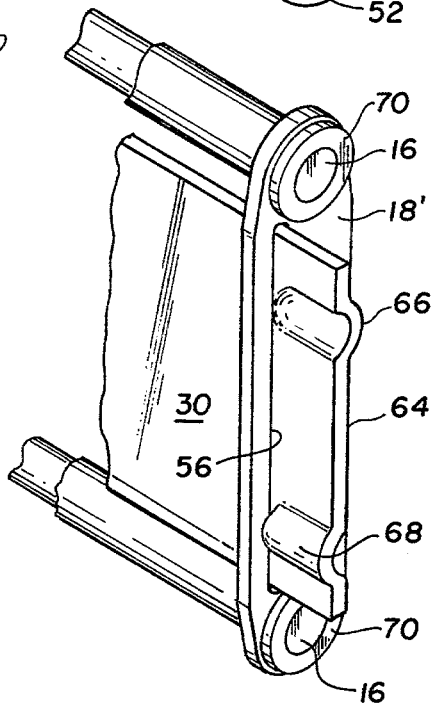

Remaining FIGS. 3–6 illustrate the within improved grille with integrated plastic slats. More particularly, FIG. 3 is a partial perspective view thereof illustrating the simple, yet effective, manner in which the plastic slats are maintained in position on the grille;

FIG. 4 is a side elevational view, in section taken along line 4—4 of FIG. 1, illustrating the location of the opposite ends of the plastic slats within the protective confines of auxiliary structure;

FIG. 5 is a side elevational view, on an enlarged scale taken in section along line 5—5 of FIG. 3, illustrating further structural details; and FIG. 6 is a partial perspective view of a slat end further illustrating how it is retained in its position relative to the grille links.

In common use in shopping malls and the like are so-called overhead grilles which effectively function as closures for building openings, particularly store fronts. Thus, as is well understood and as is generally illustrated in FIG. 1, a shopping mall building construction 10 may typically have an opening 12 therein providing access to a retail establishment of the mall. Undoubtedly because of its more modern and favorable appearance the proprietor, rather than installing a closure that completely blocks or shuts off visibility of the interior of the retail establishment will usually utilize the referred to grille, herein generally designated 14, which, as understood, is a construction consisting of an operative arrangement of spaced apart horizontally oriented rods, individually and collectively designated 16, which are interconnected by a series of spaced apart vertically oriented links, individually and collectively designated 18. In a well known manner, grille 14 is typically operatively connected to a motor operator which raises and lowers the grille in relation to the opening 12, and thereby enables the grille to function as an effective closure for the opening.

Figure 2:
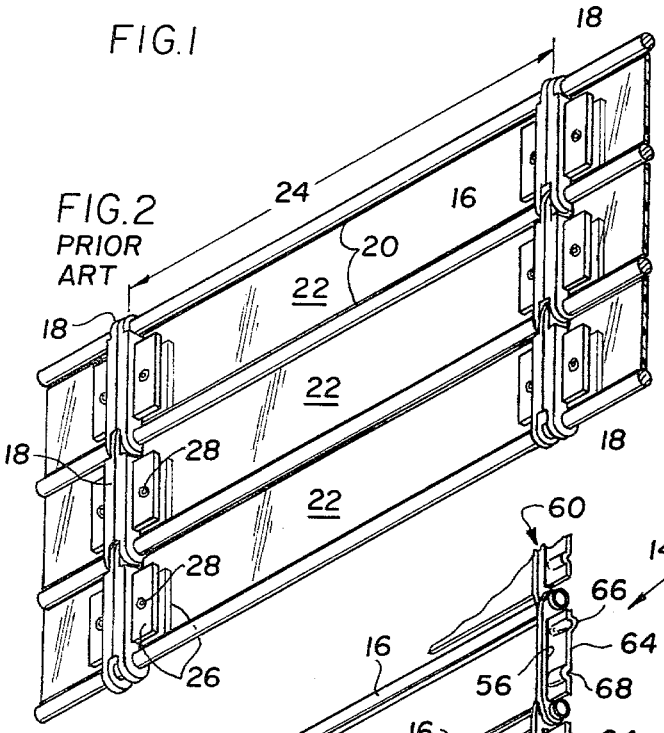
FIG. 2 is a perspective view illustrating the prior art technique for integrating plastic slats in the construction of the grille in an effort to create maximum security and visibility for same.

It is already well known, as exemplified by FIG. 2, that the grille construction consisting of the rods 16 interconnected by the links 18 does not provide adequate security for the premises behind the grille, unless each of the spaces 20 between the rods 16 is filled with a plastic slat 22. The reasoning of the prior art is undoubtedly that such slat 22, because constructed of a transparent plastic, will provide the requisite visibility, while at the same time obviating or at least minimizing foreign-matter penetration, such as lit cigarettes or even devices capable of removing products, into the premises being protected by the grille. The prior art slats 22 thus provide security which otherwise is missing in a typical rolling grille.

Installation of the slats 22, according to the prior art, at least as exemplified by U.S. Pat. No. 4,120,340, contemplates a lengthwise size in each slat that is substantially the same as the distance 24 between adjacent vertically aligned arrangements of links 18. In other words, in each horizontal position across the prior art grille of FIG. 2, a plurality of plastic slats 22 are utilized, each being of a size 24, said slats being mounted in spanning relation between the vertical arrangements of links 18. The positioning of these prior art slats 22 is completed by projecting the opposite ends between spaced apart flanges 26, and then appropriately securing these ends in place, as at 28. Since the slats 22 are provided to enhance the security of the grille, it is apparently the concept of the prior art that the method of attaching the slats to the grille, being that such attachment is exposed as illustrated in FIG. 2, that they must be as tamper-proof as possible. Thus, the links 18 are provided with the previously noted flanges 26 as an integral part thereof.

With an equally effective, yet in a significantly more simple and economical manner, the within grille 14 hereof utilizes the structure and operational arrangement as more particularly set forth in FIGS. 3–6 to add high resistance plastic slats, individually and collectively designated 30, to a grille of standard construction to provide the desired solid barrier creating maximum security and visibility, minimum foreign-matter penetration, as well as to achieve other commercially desirable objectives. Before describing in detail the structural features embodied in the grille 14 making the aforesaid possible it is helpful to note that underlying the present invention is the recognition that security for the method by which the slats are incorporated in the grille can be effectively and advantageously achieved by the positioning thereof within the confines of the structure used to provide proper tracking to the grille 14. More particularly, as may be best appreciated by reference to FIGS. 1 and 4, situated along the opposite sides of the building opening 12 are hollow members 32 and 34 which, as exemplified by member 34 in FIG. 4, include two laterally extending walls 36 and 38 which bound therebetween the compartment 40. At their free ends these walls have inturned flanges which cooperate to provide a vertical guideway 42 for each opposite end of the grille, generally designated 44. Thus, each end 44 is projected through a guideway 42 into compartment 40 to insure that there will be proper tracking of the grille during its up and down movements within the opening 12. For completeness' sake it is mentioned that each vertical guideway 44 has weatherstripping 46 to minimize water penetration into the compartment 40. To summarize, therefore, underlying the present invention is the recognition that in the operational mode of the grille 14 that the opposite sides 44 thereof are located within each compartment 40, ostensibly for tracking purposes, but that such positioning, in accordance with the present invention, also effectively provides security for such ends in obviating any tampering by the public with this portion of the grille.

Combined with the positioning in compartment 40 as just noted, the improved grille 14 according to the present invention contemplates the use of rod-interconnecting links 18' in which there are at opposite ends openings 50 and 52 appropriately sized to allow the projection therethrough of the rods 16 and plastic spacers 54. In slightly offset relation to the vertically aligned openings 50 and 52 in each link 18' is a generally rectangular shaped slot 56 which will be understood to be appropriately sized to receive the rectangularly shaped plastic body of each slat 30.

Although the manner of interconnecting the rods 16 and links 18' is well understood, for completeness' sake reference should be made to FIG. 3 which illustrates the overlapping of the vertically aligned links 18', as at locations 58, and the positioning through the aligned openings of such overlapping links of the rods 16 to thereby support the rods 16 in spaced horizontal relation to each other.

Following the interconnection of the rods and links 16 and 18' as just noted, the present invention contemplates the use of plastic slats 30 with a length in each sufficient to extend the entire width of the grille 14 and thus of the opening 12, including the projection of the opposite ends of the slats 30 into the compartments 40 as already noted. In other words, each slat 30 is projected through the slots 56 of the links 18' so that each extends the entire width of the grille 14. After this is achieved, and before actually positioning the grille 14 in the opening 12, all the ends of the slats 30 that extend beyond the outermost vertical alignment of links 18', such series of links on the right side of the grille being specifically designated 60 in FIG. 3, are appropriately modified in shape so that these slat ends can no longer slide through the slots 56. Preferably, the shape modification is achieved by cold-crimping these slat ends, individually and collectively designated 64, as at 66 and 68. More particularly, and as is best illustrated in FIG. 6, crimp 66 is preferably embodied in the slat ends 64 in one direction and crimp 68 in the opposite direction. The result is that the crimps 66 and 68 represent construction material of slat 30 that has been forced out of the flat plane thereof, and thus effectively incapacitates each slat end 64 from sliding through the narrower dimension of the slot 56 of the link 18' in the immediate adjacent position to each slat end 64. Still referring to FIG. 6, for completeness' sake it should be noted that at the opposite sides of the grille the rods 16 are provided with so-called end links 70 which effectively interconnect rods 16 to those links 18' located along the opposite sides of the grille.

Following the positioning and then crimping of the slats 30 in the grille arrangement of rods 16 and links 18', the grille is then set up in a well known manner so as to effectively function as a closure for the building opening 12. As already noted, this operative position of the grille 14 includes the projection of each of the opposite sides 44 thereof between the weatherstripping 46 of a vertical guide groove 42 and thus into an out-of-reach position within each of the track compartments 40, as illustrated in FIG. 4. As a result, the plastic slats are maintained just as effectively in their position in the grille as they are by the prior art structure already noted in connection with FIG. 2 hereof, and yet this is achieved by simple-to-apply crimps 66 and 68, which are protected against unauthorized tampering because of their protected position within the track compartments 40. Consistent with providing maximum security, the present invention also contemplates the use as the construction material for the slats 30 of a high resistant plastic, one such appropriate material being a polycarbonate plastic sold under the trademark "Lexan" by Commercial Plastics & Supply Corp. of 55 Marine Street, Farmingdale, N.Y.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. As a closure for a building opening, an improved vertically movable grille operatively disposed for opening and closing movement in said building opening comprising, in combination, two vertically oriented hollow members each disposed along an opposite side of said building opening and each having a vertically oriented slot in facing relation to said building opening so as to provide vertical guideways for said grille, a grille body formed of horizontally oriented spaced apart rods interconnected by vertically oriented links in attached relation to adjacent pairs of said rods, each said link having a slot of a selected size therein, plural transparent plastic slats having operative horizontally oriented positions resulting from being projected through said slots of said links in horizontal alignment with each other, each said slat being of a transverse size such that the opposite ends thereof extend through said guideway slots into said hollow members, and crimps in the construction material of each of said slats at said opposite ends within said hollow members effective to modify the shape thereof so as to obviate sliding movement of said slat ends through said slots of those of said links adjacent said ends, whereby said crimped slat ends are only nominally vulnerable to tampering in said hollow members while being effective in maintaining said slats in position on said grille.

2. The combination in an improved grille as defined in claim 1 wherein each slat is flat, and said crimps therein extend out of said flat plane, to thereby provide said shape which obviates the sliding movement of said slat ends through said link slots.

3. The combination in an improved grille as defined in claim 2 wherein said construction material of said slats is a high impact resistant polycarbonate plastic.

4. The combination in an improved grille as defined in claim 3 including a vertical orientation of said links in immediate adjacent relation to each of said slat opposite ends, whereby there is an optimum minimum transverse movement in said slats before abutment of said crimps against said links.

* * * * *